United States Patent [19]

Noguchi et al.

[11] 4,195,649

[45] Apr. 1, 1980

[54] TOBACCO SMOKE FILTER

[75] Inventors: Katsuichi Noguchi; Kazuo Maeda; Yuriko Anzai, all of Yokohama; Minoru Hirai, Shizuoka; Kazuo Izumi, Shizuoka; Kenji Niijima, Shizuoka, all of Japan

[73] Assignees: Toho Beslon Co., Ltd.; The Japan Tobacco and Salt Public Corp., both of Tokyo, Japan

[21] Appl. No.: 869,340

[22] Filed: Jan. 13, 1978

[30] Foreign Application Priority Data

Jan. 13, 1977 [JP] Japan ..... 52-1866

[51] Int. Cl.[2] ..... A24B 15/02

[52] U.S. Cl. ..... 131/261 R; 423/447.1

[58] Field of Search ..... 131/200–203, 131/261 R, 261 B, 262 R, 262 A, 264, 266, 268; 55/387, 498, 512, 527–528; 106/56, 307; 252/421, 510–511; 423/444, 447.1, 447.6, 447.7

[56] References Cited

U.S. PATENT DOCUMENTS

| | | | |
|---|---|---|---|
| 3,011,981 | 12/1961 | Soltes | 131/261 R |
| 3,319,629 | 5/1967 | Chamberlain | 131/261 R |
| 3,337,301 | 8/1967 | McWhorter et al. | 423/447.7 |
| 4,009,305 | 2/1977 | Fujimaki et al. | 423/447.1 |
| 4,080,417 | 3/1978 | Kishimoto et al. | 423/447.1 |

FOREIGN PATENT DOCUMENTS 2715486 4/1978 Fed. Rep. of Germany .

*Primary Examiner*—Robert W. Michell
*Assistant Examiner*—C. F. Rosenbaum
*Attorney, Agent, or Firm*—Sughrue, Rothwell, Mion, Zinn and Macpeak

[57] ABSTRACT

A tobacco smoke filter capable of selectively removing irritating materials and unpleasant bitter components from tobacco smoke and containing as a filter element nitrogen-containing activated carbon fibers produced by oxidizing acrylonitrile polymer fibers and then activating the oxidized fibers.

20 Claims, 1 Drawing Figure

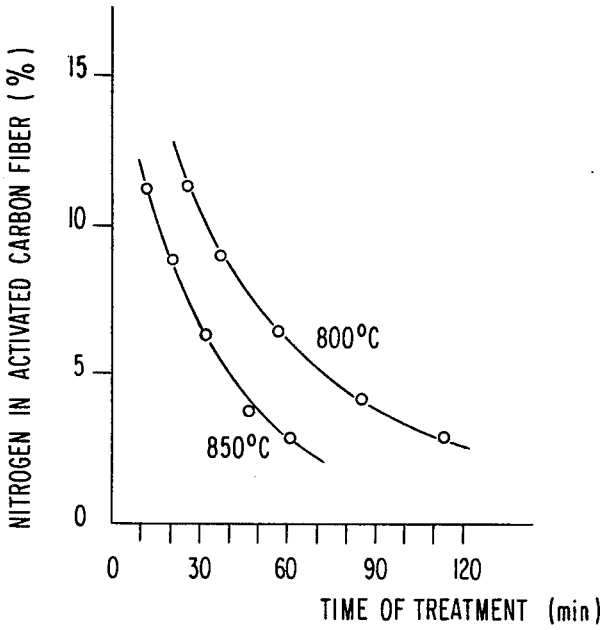
NITROGEN IN ACTIVATED CARBON FIBER (%)
15
10
5
0
800°C
850°C
0
30
60
90
120
TIME OF TREATMENT (min)

TOBACCO SMOKE FILTER

BACKGROUND OF THE INVENTION

1. Field of the Invention

This invention relates to an improved tobacco smoke filter, and more particularly, to a tobacco smoke filter using as a filter medium nitrogen-containing activated carbon fibers.

2. Description of the Prior Art

Tobacco smoke generally consists of a particulate component (a condensed phase comprising crude tars) and a gaseous vapor-phase component. The particle-phase component comprises tars which include a number of chemical components such as terpenes, phenols, carbonyl compounds and organic acids, alkaloids such as nicotine and nolnicotine, and water; the gaseous vapor-phase component comprises air, carbon monoxide, carbon dioxide, methane, isoprene, acetone, acetaldehyde, benzene and water vapor.

Among these particle-phase components and gaseous vapor-phase components are chemical components that are not desired from the standpoint of health and the flavor of tobacco. Most of the current commercial tobacco products are shifting to those tipped with filters because tobacco smoke filters have an effect of filtering and adsorbing part of these undesired chemical components as well as of giving a lightness to the tobacco taste.

Commercially available filter media for use in tobacco smoke filters, such as acetate fibers, paper, nonwoven fabrics made from pulp, and wool, are used primarily for the purpose of filtering out the particle-phase component and they generally have a filtrability of 30 to 60%. However, these fibers are incapable of filtering and adsorbing the gaseous vapor-phase component, and so, according to a recent and now widely used method, activated carbon is deposited on, or filled in the spaces between, the filter media for the primary purpose of filtering and adsorbing the gaseous vapor-phase component. Examples of commercial products that utilize this method are a dual filter wherein an activated carbon-deposited acetate filter which has activated carbon particles or powder added to acetate fibers is combined with an acetate filter comprising acetate fibers only; a dual filter wherein an active carbon-containing paper filter which has activated carbon added to paper is combined with an acetate filter; and a triple filter which has activated carbon particles filled in a small space between two acetate filters or paper filters. However, these conventional filters have several problems which need to be solved.

In the dual system filter wherein activated carbon particles or powder is added to acetate fibers or paper, various additives such as bonding agents or plasticizers are used to firmly fix the activated carbon to the fibers or paper so it will not come off easily. Unfortunately, such additives invariably impair the ability of the activated carbon to adsorb and remove the gaseous vapor-phase component, resulting in a decreased filtering efficiency on smoking.

A triple filter system has a rather complicated structure, and so, high-speed processing for making such filters is difficult to implement, and the cost of production is high. What is more, voids tend to be formed between the activated carbon particles filled and the surrounding filter wrapper, and smoke passes through the voids without contacting the carbon particles, causing a decrease in the filtering action on smoking.

Approaches which use carbon fibers in an apparent attempt to improve these tobacco smoke filters using activated carbon as a filtering material are disclosed in Japanese Patent Publication No. 21655/64, Japanese Patent Publication No. 23980/68, Japanese Patent Publication No. 23970/68, and U.S. Pat. No. 3,011,981. These approaches present an advantage in shaping the filters because they use carbon in fibrous form rather than in particulate form. However, since the activated carbon fibers which are employed are merely a carbonized product of cellulose fibers, they are not likely to remove effectively the gaseous vapor components from tobacco smoke, and in addition, their ability to selectively adsorb and remove undesired components is poor.

SUMMARY OF THE INVENTION

Therefore, one object of this invention is to provide a filter having a high ability to remove irritating substances and unpleasant bitter components from tobacco smoke.

Another object of this invention is to provide a filter having an extremely high adsorption rate.

Still another object of this invention to provide a filter which is easy to produce and which can easily be attached to tobacco products.

The tobacco smoke filter according to this invention contains as a filter element nitrogen-containing activated carbon fibers obtained by oxidizing acrylonitrile polymeric fibers and activating the oxidized acrylonitrile polymeric fibers.

BRIEF DESCRIPTION OF THE ACCOMPANYING DRAWING

The FIGURE is a graph showing the relationship between conditions for activating nitrogen-containing oxidized fibers derived from acrylonitrile polymers and the nitrogen content of the fibers.

DETAILED DESCRIPTION OF THE INVENTION

The irritating acidic substances in tobacco smoke include lower organic acids, that is, saturated or unsaturated aliphatic mono- and dicarboxylic acids having 1 to 4 carbon atoms (including those substituted with a methyl group, an ethyl group, a hydroxy group, and the like), such as formic acid, acetic acid and crotonic acid; unsubstituted or substituted (for example, with an alkyl group having 1 to 4 carbon atoms) mono- and dihydric phenols, such as phenol, p-cresol and catechol; saturated or unsaturated aliphatic aldehydes and dialdehydes having 1 to 4 carbon atoms (including those substituted with a methyl group, an ethyl group, etc.), such as formaldehyde, acetaldehyde, propionaldehyde, oxalaldehyde (glyoxal); hydrogen cyanide; ketones having 1 to 4 carbon atoms, such as acetone; unsubstituted or substituted (for example, with a halogen atom or a hydroxy group) nitriles having 1 to 4 carbon atoms, such as acetonitrile; nitrogen oxides such as NO, $NO_2$, $N_2O_4$, $N_2O_3$ and $N_2O_5$; sulfur oxides such as $SO_2$ and $SO_3$; hydrogen sulfide; saturated aliphatic mercaptans having 1 to 4 carbon atoms, such as ethyl mercaptan and peroxide compounds.

The nitrogen-containing activated carbon fibers used in this invention are prepared, for example, by oxidizing polyacrylonitrile fibers in an oxidizing atmosphere under tension at a temperature in the range of about 200° to about 300° C. until the amount of bonded oxygen reaches about 50 to about 90% of the saturated amount of bonded oxygen, followed by the activation thereof (as disclosed in U.S. patent application Ser. No. 785,888, filed on Apr. 8, 1977, British patent application Ser. No. 13586/1977, German patent application Ser. No. 2715486.5/1977 and Canadian patent application Ser. No. 276,017/1977).

The acrylonitrile polymeric fibers used as the starting material in this invention are those comprising a homopolymer of acrylonitrile or a copolymer containing acrylontrile. Suitable copolymers containing acrylonitrile are, in general, those which contain more than about 60 wt.%, preferably more than about 85 wt.%, acrylonitrile. Fibers comprising a mixture of copolymers can also be used. A copolymer containing less than about 60 wt.% of acrylonitrile can be admixed with an acrylonitrile-containing polymer (i.e., a homopolymer or copolymer of acrylonitrile) so long as the resulting acrylonitrile content in the fibers is more than about 60 wt.%.

Examples of comonomers which can be employed in the acrylonitrile copolymer are addition polymerizable vinyl compounds or allyl compounds such as vinyl chloride, vinylidene chloride, vinyl bromide, acrylic acid, methacrylic acid, itaconic acid, salts of these acids (e.g. the sodium salts) and derivatives of these acids, such as acrylic acid esters (for example, alkyl esters wherein the alkyl group has 1 to 4 carbon atoms, such as methyl acrylate or butyl acrylate), methacrylic acid esters (for example, alkyl esters wherein the alkyl group has 1 to 4 carbon atoms, such as methyl methacrylate), acrylamide and N-methylol acrylamide; allyl sulfonic acid, methallyl sulfonic acid, vinyl sulfonic acid and the salts of these acids (e.g., the sodium salts), and vinyl acetate (those compounds described in U.S. Pat. No. 3,202,640, etc. can also be used).

The degree of polymerization of these polymers or polymer mixture is not limited and such is suitable if fibers can be formed therefrom. In general, a suitable degree of polymerization is about 500 to about 3,000, preferably, from about 1,000 to about 2,000.

The acrylonitrile polymer can be prepared using any conventional method; for instance, the polymer can be prepared using suspension polymerization or emulsion polymerization in the aqueous system, or solution polymerization in a solvent (for example, as disclosed in U.S. Pat. Nos. 3,208,962; 3,287,307; 3,479,312).

The acrylonitrile polymer can be spun into a fiber using any conventional method such as using a wet spinning or dry spinning process. Suitable spinning solvents include inorganic solvents such as a zinc chloride-rich aqueous solution and concentrated nitric acid or organic solvents such as dimethylformamide, dimethylacetamide and dimethyl sulfoxide. A wet spinning comprises an appropriate combination of coagulation, washing, stretching, shrinking and drying steps (for details of this process and the dry process as well, see U.S. Pat. Nos. 3,135,812; 3,097,053). The degree of stretching may be equal to that required in stretching ordinary acrylonitrile fibers; in other words, a degree of stretching of about 5 to 30 times the original length. The strength of the resulting activated carbon fibers is substantially proportional to that of the acrylonitrile fibers as the starting material.

If an organic solvent is used in spinning, care must be taken to minimize the amount of the residual solvent in the fibers because it may possibly cause the fibers to become brittle when they are being oxidized. For this reason, an inorganic solvent is preferred as a spinning solvent. Especially, the use of a zinc chloride-rich aqueous solution is advantageous because the residual zinc chloride in the fibers helps shorten the activation time and produce fibers of high strength.

Fibers of any diameter can be used as the starting material, but generally, from the standpoint of ease of processing, fibers of a diameter of about 5 to about 30$\mu$, preferably, about 10 to about 20$\mu$, are used.

The oxidizing atmosphere required for the oxidation treatment is usually air, but a mixture thereof with an inert gas, for example, nitrogen, may be used if the gas mixture contains more than about 15 vol% of oxygen. The oxidation may be carried out in an atmosphere of gaseous hydrogen chloride, sulfur dioxide, NO or $NH_3$, but generally a mixture of air (containing about 5 to about 20 vol% of oxygen) is used.

A suitable oxidation temperature ranges from about 200° to about 300° C., preferably from about 220° to about 280° C. If the temperature is lower than about 200° C., a long time is required to finish the oxidation, and if the temperature is higher than about 300° C., the fibers will burn or the oxidation proceeds too rapidly for a uniform reaction to be achieved. The temperature may be changed during the course of the oxidation procedure. Since the oxidation rate may gradually decrease as the oxidation reaction proceeds, it is preferred to gradually increase the temperature within the range of 200° to 300° C. accordingly.

There is no particular limitation on the amount of tension applied in the course of oxidation, but a preferred range is such that the shrinkage at a given oxidation temperature is about 50 to about 90% of the free shrinkage ratio at that temperature. If the shrinkage ratio is below about 50%, the filaments will break, and if the shrinkage ratio is greater than about 90%, the fibers obtained after the activation treatment will have deteriorated mechanical properties. By operating in the above defined range, fibers having a tensile strength higher than about 20 kg/mm$^2$ are obtained.

The term "free shrinkage ratio" at a given oxidation temperature is used herein to mean the ratio of shrinkage to the original length of the fibers as they shrink during the course of oxidation in an oxidizing atmosphere under a load of more than about 1 mg/d, usually about 1 mg/d to about 100 mg/d. The tension is applied to prevent the fiber from being loose.

The degree of oxidation occuring in this oxidation treatment is determined by the amount of bonded oxygen. The minimum required amount of bonded oxygen is about 30% of the saturated amount of bonded oxygen to the starting filaments to be subjected to oxidation, but in order to obtain carbon fibers capable of adsorbing a larger amount and adsorbing at a higher rate, it is preferred for a sufficient amount of oxygen to be bonded to the fibers at oxidation. Therefore, the fibers must be oxidized to the e..tent of about 50 to about 90% of the saturated amount of bonded oxygen. Incidentally, the amount of bonded oxygen in preparing carbon fibers is in the order of 40%.

The term "saturated amount of bonded oxygen" as used herein is defined as follows. The starting material fibers are oxidized in an oxidizing atmosphere and sampling is performed as the oxidation reaction proceeds. When the amount of bonded oxygen to the fibers stops changing, the amount of bonded oxygen at that time is determined, and that amount is defined as the "saturated amount of bonded oxygen." This value directly depends upon the composition of the polymers that constitute the fibers.

The time required for heat treatment is correlated with the temperature at which the treatment is carried out, but, in general, the time ranges from about 2 to about 24 hours.

The oxidized fibers are then activated. The activation may be carried out by using a gas or, prior to activation with a gas, by impregnating the fibers with an activating agent commonly used as a chemical for activation (for example, as disclosed in U.S. Pat. Nos. 2,790,781 and 2,648,637). An example of activation with heat within an inert gas is to use $NH_3$, $CO_2$, steam or a mixture of these (the allowable limit of oxygen content is generally less than about 3 vol% so that the fibers do not burn) at a temperature within the range of about 700° to about 1000° C. for a period of from about 10 minutes to about 3 hours.

When a chemical activation agent is impregnated in the oxidized fibers prior to activation with a gas, those activating chemicals which are commonly used for producing activated carbon may be employed. For instance, the oxidized fibers can be immersed in, or sprayed with, an aqueous solution of zinc chloride, phosphoric acid, sulfuric acid, sodium hydroxide, hydrochloric acid or so forth (generally, an aqueous solution of hydrochloric acid of a concentration of about 10 to about 37 wt.%, and an aqueous solution of the other chemicals of a concentration of about 10 to about 60 wt.% is used) so as to deposit such chemicals on the fibers, followed by activation in an activating gas at a temperature which generally ranges from about 700° to about 1000° C. for a period generally extending from about 10 minutes to about 3 hours. In this instance, the chemicals are deposited on the fibers in an amount of about 0.1 to about 20 wt.% based on the weight of the fibers. The fibers are free to shrink in the course of activation treatment. The shrinkage ratio is generally about 10 to about 30% of the length of the oxidized fibers.

As a result of the activation, volatile components are removed from the fibers, and the fibers are carbonized, while at the same time, the specific surface area of the fibers is increased. The activated carbon fibers used in this invention advantageously have a specific surface area of about 100 to about 1500 $m^2/g$, and more preferably, a specific surface area of about 200 to about 800 $m^2/g$., with nitrogen being present in the fibers in an amount of about 2 to about 15 wt.% and about 4 to about 10 wt.%, respectively and with the pore volumes present in the fibers being about 0.1 to about 1 ml/g and about 0.2 to about 0.7 ml/g, respectively. The diameter of the activated carbon fibers thus obtained is about 3 to about 40μ. The specific surface area of the fibers can be determined using the well-known BET method and the pore volume of the fibers can be determined in accordance with the adsorption method using nitrogen gas. These methods were used to obtain the values given above for the specific surface area and pore volume.

Turning now to the FIGURE, the FIGURE shows the relationship between the conditions, i.e., temperature and time, for activating the oxidized fibers with steam and the nitrogen content in the resulting activated oxidized fibers. The oxidized fibers used therein were prepared from a polymer (having a molecular weight of about 90,000) comprising 96 wt.% of acrylonitrile and 4 wt.% of methyl acrylate.

Thus, the nitrogen content and the specific surface area of the activated carbon fibers can be controlled by varying the activation conditions. The pore volume is substantially proportional to the specific surface area.

The oxidized fibers may be subjected to a treatment to provide crimps in the fibers, and then the fibers subjected to a activation treatment as described above. The crimped fibers do not contact each other tightly, therefore they are convenient to use as a core of a filter plug as described hereinafter.

The nitrogen-containing activated carbon fibers of this invention that are produced from acrylonitrile polymeric fibers have an extremely high capability of adsorbing irritating substances in tobacco smoke as compared with nitrogen-free activated carbon fibers prepared from rayon e.g., regenerated cellulose. Table 1 shows the results of a comparison of the adsorptivity of the two fibers in accordance with a column test. The adsorptivity is expressed in terms of wt.% of adsorbate on the basis of the weight of adsorbent.

Table 1

| Gas Adsorbate | ACF from PAN[1] (%) | ACF from Rayon[2] (%) | Measurement Conditions: Inlet Gas Concentration[5] (ppm) | Measurement Conditions: Temperature (°C.) |
|---|---|---|---|---|
| Ethyl Mercaptan | 2.8 | 1.6 | 2-4 | 23 |
| Hydrogen Sulfide | 0.5 | 0.005 | 4-5 | 30 |
| $SO_x$[3] | 1.2 | 0.04 | 10 | 23 |
| $NO_x$[4] | 0.7 | 0.15 | 12 | 25 |
| Ozone | 36-39 | 0.3-0.5 | 1-1.5 | 25 |
| Toluene | 18-20 | 22-24 | 100 | 30 |
| Butyric Acid | 9 | 7 | 100 | 23 |

[1]Activated carbon fibers obtained from polyacrylonitrile (PAN) having a nitrogen content of 6-8 wt. % and a specific surface area of 800 $m^2/g$
[2]Activated carbon fibers obtained from rayon with no nitrogen present and a specific surface area of 1200 $m^2/g$
[3]Mixture of $SO_2$ and $SO_3$
[4]Mixture of NO, $NO_2$, $N_2O_4$, $N_2O_3$, $N_2O_5$, etc.
[5]Concentration at the inlet of the column The activated carbon fibers thus obtained may be made into a filter in the same way as conventional acetate fibers are shaped. More specifically, the activated carbon fibers are longitudinally aligned in a parallel orientation to form a cylindrical body consisting only of the activated carbon fibers. However since activated carbon fibers are generally expensive, and since no particular advantage results from using them alone to make a filter, they are desirably combined with one or more fibrous materials that have been conventionally incorporated into a tobacco filter, such as pulp, acetate fibers, rayon fibers, polypropylene fibers, etc. A suitable weight ratio of the activated carbon fibers of this invention to conventional fibrous materials is about 30:10 to about 50:50. Examples of suitable methods of combination are spirally winding a mixed paper or non-woven fabric of these conventional fibrous materials and the nitrogen containing activated carbon fibers of this invention into a cylindrical form; blending the filaments of the activated carbon fibers of this invention with other conventional fibers described above and forming the blend into a filter plug; concentrically arranging conventional fibrous materials such as acetate filaments around a core of the activated carbon fibers of this invention to thereby form a filter plug; combining a cylindrical felt of the activated carbon fibers of this invention with a filter tip made of other conventional fibers; inserting the above described non-woven fabric into a cylindrical filter made of fibers other than the activated carbon fibers of this invention vertically in the longitudinal direction of the filter; and appropriately combining these methods to made a filter. Further, additional examples of methods for producing tobacco filters utilizing fibers are disclosed in U.S. Pat. Nos. 3,905,377, 3,904,577, 3,903,898, 3,856,025, 3,858,587, 3,861,404, 3,877,470, 3,878,853, 3,887,730 and 3,888,160. Any one of these methods can be employed in this invention.

It is generally advantageous to use about 20 to about 60 mg of the activated carbon fibers of this invention per gram of tobacco leaf, and a preferred amount is from about 35 to about 45 mg per gram of tobacco leaf.

Some of the characteristic features and advantages of this invention are explained in detail below.

First, this invention provides a filter that is very capable of removing the above-described irritating acidic materials from this invention contain nitrogen as one of their constituent elements. Analysis shows half of the nitrogen atoms are basic, and so, they have selective affinity for the above acidic materials, especially, for lower organic acids, aldehydes, hydrogen cyanide and mercaptans. The filter of this invention is also capable of removing components present in low concentration.

Secondly, in addition to the removal of the irritating acidic materials mentioned in the above paragraph, unpleasant bitter components can also be removed from tobacco smoke through the use of the activated carbon fibers of this invention, resulting in a significant improvement in the flavor qualities of the tobacco.

Thirdly, unlike active carbon particles, the activated carbon fibers of this invention will not come off the filtering materials with which they are combined thus entirely obviating the need for a fixing agent that impairs their filter ability to remove undesired components from the smoke. Therefore, the filtering action of the activated carbon fibers of this invention is exhibited to a satisfactory extent when required on smoking.

Fourthly, the use of the activated carbon fibers of this invention helps eliminate all of the difficulties that have been conventionally encountered with the use of activated carbon particles during the process of producing filters and the subsequent process of producing filter-tipped tobacco products. It is inevitable when activated carbon particles are used that part of them comes off during the filter making process or the process for connecting the filters to tobacco. Accordingly, a special means has been required for preventing pollution at job sites or malfunction of machinery due to activated carbon particles which drop off. However, such a pollution prevention device is not required if the activated carbon fibers of this invention are used since they present none of these obstacles in the production of filters or filter-tipped tobacco products.

Fifthly, the activated carbon fibers of this invention are especially adapted for use in a tobacco filter because they have an extremely high adsorption rate compared with conventional active carbon particles.

Sixthly, as demonstrated in Table 1 above, the filter of this invention has a superior ability to a filter that incorporates nitrogen-free activated carbon fibers in its ability in removing acidic substances, ozone, toluene, etc. from tobacco smoke.

This invention will be explained in greater detail by reference to the examples set forth below. The activated carbon fibers of this invention used in the following examples were produced using either Method No. 1 or Method No. 2 described below. Unless otherwise stated, percentages are by weight.

Method No. 1

Acrylonitrile polymeric fibers (having a molecular weight of about 90,000) comprising 97% acrylonitrile and 3% methyl acrylate were used as the starting material. The fibers had a size of 3 d and were formed into tows, with each tow consisting of 20,000 filaments.

Each tow was subjected to a continuous 5-hour treatment under a tension of about 50 mg/d, in air in an electric oven maintained at 260° C. The amount of bonded oxygen to the fibers thus treated was 70% of the saturated amount of bonded oxygen. The treated tow was then activated with steam in the following manner. While continuously supplying superheated steam from an inlet at the bottom of a vertical hollow electric oven at a rate of 100 l/min, 5 such tows were fed from the top of the oven into an area maintained at 780° C. at a rate of 6 m/hr and activated for 20 minutes.

The active carbon fibers thus obtained had a strength of 35 kg/mm$^2$, a diameter of 12$\mu$, a specific surface area of 550 m$^2$/g and a nitrogen content of 8%.

Method No. 2

Acrylonitrile polymer fibers (having a molecular weight of about 90,000) comprising 96% of acrylonitrile and 4% of acrylic acid were used as the starting material. The fibers had a size of 5 d and were formed into tows, with each tow consisting of 260,000 filaments. Each tow was subjected to a continuous 7-hour treatment under tension (about 100 mg/d) in air in an electric oven controlled at 250° C. The amount of bonded oxygen to the fibers thus treated was 80% of the saturated amount of bonded oxygen. As an agent for increasing the activation rate and improving carbonization yield, 5% aqueous solution of phosphoric acid was added to the tow thus treated, and after drying, the tow was activated with steam in an oven as described in Method No. 1. More specifically, the tow was fed into a steam atmosphere maintained at 780° C. at a rate of 6 m/hr and activated for 20 minutes. The rate of supply of superheated steam was 300 l/min.

The active carbon fibers thus obtained had a strength of 30 kg/mm$^2$, a diameter of 13$\mu$, a specific surface area of 470 m$^2$/g and a nitrogen content of 8.4%.

EXAMPLE 1

Samples of non-woven fabric were prepared from the activated carbon fibers produced in accordance with Method Nos. 1 and 2 in combination with various conventional filtering materials.

A testing machine which operated in the same manner as a non-woven fabric making machine of the Proctor & Schwaltz Corporation was employed. Fibers supplied from the horizontal apron of the hopper feeder were carded on a Garnett machine to form a web, which was passed through a lap former to be continuously fed onto the delivery apron to make a crossed web. The crossed web was immersed in a binder bath comprising a 4% aqueous solution of polyvinyl alcohol, and dried (the dry weight of the binder was about 6% of the fibers) so as to bond the individual fibers together. The composition and physical properties of each non-woven fabric sample thus obtained are set forth in Table 2 below.

Each of these samples was cut into 16 cm widths and 3–10 m lengths, joined with a 46 g/m$^2$ pulp sheet by means of a double-coated adhesive tape, and rolled up into a cylindrical form with a roll-up machine. All of the filters prepared from these non-woven fabric samples had good appearance and high elasticity. The filters obtained were designated Filter Nos. 1 to 3, respectively.

Table 2

Composition and Physical Properties of Non-woven Fabric Samples

| Sample No. | Fiber | Size (denier) | Fiber Length (mm) | Composition (%) | Weight (g/m$^2$) | Thickness (mm) | Tensile Strength (g) | Elongation (%) | Filter No. |
|---|---|---|---|---|---|---|---|---|---|
| 1 | Polypropylene | 3 | 76 | 40 | | | | | |
| | Rayon | 2 | 51 | 30 | 55 | 0.60 | 370 | 40 | 1 |
| | ACF (Method No. 1) | 1 | 51 | 30 | | | | | |
| 2 | Acetate | 4 | 44 | 40 | | | | | |
| | Rayon | 2 | 51 | 30 | 59 | 0.48 | 870 | 14 | 2 |
| | ACF (Method No. 2) | | 51 | 30 | | | | | |
| 3 | Acetate | 2.1 | 51 | 50 | | | | | |
| | ACF (Method No. 2) | 1 | 51 | 50 | 62 | 0.52 | 600 | 28 | 3 |

Tensile Strength Measurement

The tensile strength was measured using a tensile strength tester "Instron" (trade name, manufactured by Instron Corporation).

Width of Sample: 30 mm

Interval of Grips of the Sample: 100 mm

Tensile Velocity: 20 mm/minutes

The values in Table 2 above were obtained by converting the values determined as shown above into a value for samples having a width of 15 mm.

EXAMPLE 2

A filter was prepared from pulp and activated carbon fibers using the following method. Pulp for a tobacco filter made from an acicular or needle-leaved tree was fluffed up using a disintegrator, uniformly blended with activated carbon fibers (having a fiber length of 2–5 mm) produced by Method No. 1 in a 1:1 weight ratio and then shaped into a mat on a wire screen, Both sides of the mat was sprayed with a 1% aqueous solution of polyvinyl acetate, and dried with hot air at 150° C. (to a dry weight of 6%) to form a non-woven fabric sheet. The sheet was cut into 14.3 mm widths, each quartered with a shaping machine, and rolled up in an S-shape using a rolling machine to obtain a filter plug. (The filter is designated Filter No. 4 and its characteristics are shown in Table 3 below).

EXAMPLE 3

An acetate tow consisting of 8250 filaments, each of a size of 4 denier, having a Y-shaped cross section was blended in a 1:1 weight ratio with activated carbon fibers produced by Method No. 1 in the direction of the axes of the fibers, to thereby form a filter plug of 17 mm cuts. The filter was identified as Filter No. 5 and its characteristics are shown in Table 3 below.

Cigarette specimens were then prepared from Filters Nos. 1 to 5 obtained in Examples 1 to 3, an acetate filter (Filter No. 6) as a control consisting of a plurality of 4 denier filaments of a Y-shaped cross section to a total denier of 43000, and a charcoal filter (Filter No. 7) containing 40 mg of active carbon produced from coconut shell in the acetate filter by connecting these filters to "Hi-lite" (trade-name of a cigarette produced by the Japan Tobacco and Salt Public Corporation) from which the filter tip had been removed. These specimens were smoked and organoleptically evaluated by a panel of 10 members for smell, taste, bitterness, irritation and charcoal taste. The results obtained are shown in Table 3 below.

Table 3

Smoking Test Evaluation

| Filter No. | Evaluation | | | | |
|---|---|---|---|---|---|
| | Smell | Taste | Bitterness | Irritation | Charcoal Taste |
| 1 | +0.5 | +1.0 | +2.0 | +2.0 | +2.5 |
| 2 | +0.5 | +1.0 | +2.0 | +2.0 | +2.5 |
| 3 | +0.5 | +1.0 | +2.0 | +2.5 | +2.5 |
| 4 | +0.5 | +1.0 | +2.0 | +2.5 | +2.5 |
| 5 | +0.5 | +1.0 | +2.0 | +2.5 | +2.5 |
| 6 | 0 | 0 | 0 | 0 | — |
| 7 | −0.5 | −0.5 | +0.5 | −1.0 | 0 |

The figures in Table 3 above were obtained using a paired difference test by assigning 0 to the filler-free acetate filter (but 0 to the charcoal filter for charcoal taste or carbon smell) based on the following evaluation:

+3: Very good
+2: Quite good
+1: Good
−1: Bad
−2: Quite bad
−3: Very bad

As is evident from the results in Table 3, the filter according to this invention significantly reduced charcoal taste, irritation and bitterness of tobacco. It was also effective in significantly improving other smoking properties, as well. The resistance to air permeability, percent removal of particulate components, and percent removal of gaseous components of each of Filters Nos. 1 to 7 were also evaluated. The results obtained are shown in Table 4 below.

Table 4

| Filter No. | Filter Length (mm) | Resistance to Air Permeability (mm $H_2O$) | Removal of Particulate Components: Tars (%) | Removal of Particulate Components: Nicotine (%) | Removal of Gaseous Components: Acetaldehyde (%) | Removal of Gaseous Components: Hydrogen Cyanide (%) |
|---|---|---|---|---|---|---|
| 1 | 17 | 70 | 44 | 37 | 58 | 77 |
| 2 | 17 | 65 | 47 | 30 | 62 | 82 |
| 3 | 17 | 62 | 45 | 29 | 84 | 95 |
| 4 | 17 | 56 | 40 | 26 | 61 | 81 |
| 5 | 17 | 60 | 43 | 28 | 65 | 87 |
| 6 | 17 | 50 | 36 | 32 | 2 | 30 |
| 7 | 17 | 55 | 40 | 34 | 30 | 40 |

The results in Table 4 above as well as those in Table 3 clearly show that the tobacco smoke filter of this invention is far superior to conventional filters.

While the invention has been described in detail and with reference to specific embodiments thereof, it will be apparent to one skilled in the art that various changes and modifications can be made therein without departing from the spirit and scope thereof.

What is claimed is:

1. A tobacco smoke filter containing, as a filter element, nitrogen-containing activated carbon fibers produced by oxidizing acrylonitrile polymeric fibers having an acrylonitrile content of more than about 60% and then activating the oxidized acrylonitrile polymeric fibers.

2. The tobacco smoke filter according to claim 1, wherein the nitrogen-containing activated carbon fibers have a specific surface area of about 100 to about 1500 $m^2/g$ and a nitrogen content of about 2 to about 15 wt.%.

3. The tobacco smoke filter according to claim 1, wherein the nitrogen-containing activated carbon fibers are combined with other fibrous materials.

4. The tobacco smoke filter according to claim 1, wherein the filter comprises the nitrogen-containing activated carbon fibers and at least one of pulp, acetate fibers, rayon fibers and polypropylene fibers.

5. The tobacco smoke filter according to claim 1, consisting essentially of a paper produced from a pulp with which nitrogen-containing activated carbon fibers were blended.

6. The tobacco smoke filter according to claim 1, consisting essentially of a non-woven fabric comprising nitrogen-containing activated carbon fibers blended with at least one of acetate fibers, rayon fibers and polypropylene fibers.

7. The tobacco smoke filter according to claim 1, wherein the filter comprises a core of the nitrogen-containing activated carbon fibers concentrically surrounded by other fibers.

8. The tobacco smoke filter according to claim 1, wherein the filter comprises the nitrogen-containing activated carbon fibers in a cylindrical form combined with a filter tip made of other fibers.

9. The tobacco filter according to claim 1, wherein the filter comprises a non-woven fabric comprising nitrogen-containing activated carbon fibers inserted into a cylindrical filter made of other fibers at a right angle to the longitudinal direction of said cylindrical filter.

10. The tobacco smoke filter according to claim 1, wherein said nitrogen-containing activated carbon fibers are produced by oxidizing acrylonitrile polymeric fibers in an oxidizing atmosphere under tension at a temperature of about 200° to about 300° C. until the amount of bonded oxygen reaches about 50 to about 90% of the saturated amount of bonded oxygen and then activating said oxidized fibers to produce nitrogen-containing activated carbon fibers.

11. The tobacco smoke filter according to claim 10, wherein said tension is such that the shrinkage of said fibers at the temperature of oxidation is about 50 to about 90% of the free shrinkage ratio at that temperature.

12. A method of removing acidic materials from tobacco smoke comprising passing tobacco smoke through the tobacco smoke filter according to claim 1.

13. The tobacco smoke filter according to claim 1, wherein nitrogen is present in the fibers in an amount of about 4 to about 10 weight percent.

14. The tobacco smoke filter according to claim 1, wherein nitrogen is present in the fibers in an amount of about 2 to about 15 weight percent.

15. The process of claim 14, wherein activation is at a temperature within the range of about 700° to about 1,000° C.

16. The process of claim 15, wherein activation is for a period of from about 10 minutes to about 3 hours.

17. The process of claim 15, wherein activation is with $NH_3$, $CO_2$, steam or a mixture thereof.

18. The process of claim 17, wherein the nitrogen content of the activated carbon fibers is about 2 to about 15 weight percent.

19. The process of claim 17, wherein the nitrogen content of the activated carbon fibers is about 4 to about 10 weight percent.

20. A method of producing a tobacco smoke filter comprising oxidizing acrylonitrile polymeric fibers having an acrylonitrile content of more than about 60% in an oxidizing atmosphere under tension at a temperature of about 200° to about 300° C. until the amount of bonded oxygen reaches about 50 to about 90% of the saturated amount of bonded oxygen, activating said oxidized fibers to produce nitrogen-containing activated carbon fibers, and shaping the nitrogen-containing activated carbon fibers into a tobacco filter.

* * * * *